United States Patent [19]

Flory

[11] B 3,999,498

[45] Dec. 28, 1976

[54] ARTICULATED LOADING ARM WITH END HOSES FOR SINGLE POINT MOORING

[75] Inventor: John F. Flory, Morris Township, N.J.

[73] Assignee: Exxon Research and Engineering Company, Linden, N.J.

[22] Filed: July 1, 1974

[21] Appl. No.: 484,769

[44] Published under the second Trial Voluntary Protest Program on March 16, 1976 as document No. B 484,769.

[52] U.S. Cl. ..... 114/230; 141/387

[51] Int. Cl.[2] ..... B63B 21/00

[58] Field of Search ..... 114/230; 9/8 P; 61/46; 141/279, 284, 387, 388

[56] References Cited

UNITED STATES PATENTS

| | | | |
|---|---|---|---|
| 3,455,270 | 7/1969 | Mascenik et al. | 114/230 |
| 3,472,293 | 10/1969 | Bily | 114/230 X |
| 3,572,408 | 3/1971 | Hnot | 114/230 |
| 3,606,397 | 9/1971 | Flory | 285/185 |
| 3,840,927 | 10/1974 | Reid | 9/8 P |

*Primary Examiner*—Trygve M. Blix
*Assistant Examiner*—Sherman D. Basinger
*Attorney, Agent, or Firm*—F. Donald Paris

[57] ABSTRACT

An underwater articulated loading arm terminating in a hose or hoses, comprising a first or inboard arm connected to the base swivel of a single point mooring and a second or outboard arm pivotally connected to the free end of the inboard arm, a buoy supporting the arms at the pivotal joint, a buoy supporting the free end of the outboard arm, and a hose or hoses extending from the free end of the outboard arm for connection to the manifold of a tanker moored to the single point mooring. Cargo is transferred between the base swivel and the moored tanker through the inboard and outboard arms and the hoses.

11 Claims, 5 Drawing Figures

ARTICULATED LOADING ARM WITH END HOSES FOR SINGLE POINT MOORING

BACKGROUND OF THE INVENTION

There have been many designs proposed for the transfer of cargo between the cargo swivel of a single point mooring system and the moored tanker. Most single point mooring systems now in use employ floating cargo hose which connects to a cargo swivel mounted on the deck of a floating mooring buoy anchored by catenary chains as typically disclosed in U.S. Pat. No. 3,074,082. In that system the floating cargo hose experiences excessive wear due to flexing in the wave environment, especially at the point of connection between the hose and the buoy, and the floating cargo hose is exposed to damage by the moored tanker especially if the tanker should move forward and strike the buoy. Furthermore, the floating hose is expensive and its size limits cargo transfer rates.

Some recent single point mooring installations have used the more advanced single anchor leg mooring design disclosed in U.S. Pat. Nos. 3,606,397 and 3,641,602, assigned to the assignee of the present invention, in which the mooring buoy is anchored by a single anchor leg and the hose connects to a submerged cargo swivel which is concentric with the anchor leg and mounted either on a mooring base or on a shaft pivoted on the mooring base. In this design the problem of excessive hose wear at the buoy connected and the danger of cargo system damage resulting from a tanker impacting the buoy are eliminated.

There have been several designs proposed which are like the single anchor leg mooring and incorporate underwater rigid pipe loading arms such as that disclosed in U.S. Pat. No. 3,455,270, also assigned to the assignee of the present invention. However, it has been determined that in such cargo transfer systems the distance between the mooring point and the end of the rigid pipe loading arm is fixed, and the moored tanker cannot be permitted to move too far forward or aft of the mooring without exerting excessive forces on the loading arm.

More recently a single anchor leg mooring having an underwater articulated pipe loading arm including three pivoted segments and a loading tower pivoted at the end has been proposed as disclosed in the paper "Offshore Floating Terminals," Proceedings of the American Society of Civil Engineers WW3, August 1971. This design has the advantage that the distance between the mooring point and the loading tower at the end of the loading arm is not fixed, and the moored tanker may move forward and aft without exerting excessive forces on the loading arm, as demonstrated by model tests conducted on the system. However, these model tests have also demonstrated that the loading tower pivoted at the end of the loading arm moves around violently in waves, is difficult to constrain along the side of the tanker, and may strike the tanker resulting in damage to the tanker and the loading tower. One possible design for such a system would require extensive modifications to the tanker side and rail in order to provide strong points against which the loading tower would rest and to which the tower would be attached. Such modifications would be impractical to make on all tankers, and any such cargo handling system then would be limited to serving only a few specially modified tankers.

Furthermore, this earlier articulated loading arm is considered unstable because its three arm segments can move uncontrolled to any position between the end pivot points at the base and the tanker side. It is even possible for a pivot between two adjacent arms to pass under the keel of the moored tanker which could result in damage to the tanker or the arm.

SUMMARY OF THE INVENTION

The present invention comprises an underwater articulated loading arm for single point mooring and single anchor leg single point moorings in particular, including two arm segments with the end of the arm being supported by a buoy, and a hose serving as the cargo conduit between the end of the arm and a manifold of the moored tanker. Such a cargo transfer system combines the best features of rigid pipe and flexible hose systems. Because it uses only two segments, its configuration is stable and there is no problem of the segments moving in an uncontrolled manner. The articulated loading arm serves as a large diameter cargo conduit from the mooring point to a position near the tanker manifold, thus minimizing pressure drop. The short hoses between the end of the arm and the tanker manifold provide flexibility and eliminate the need for a rigid or close connection between the end of the arm and the tanker side. Although two is generally the maximum number of floating hoses which may be used at a single point mooring, three or four hoses could be used at the end of the articulated loading arm because the lengths are short and the hoses may be submerged beneath the sea surface when not in use. The advantages of safety due to a submerged cargo transfer system and lower maintenance costs due to reduced hose wear described earlier in reference to the single anchor leg mooring are enhanced with this system.

Accordingly, it is a primary object of the present invention to provide a mooring and cargo transfer system including an articulated loading arm having hoses at the end thereof for connection to the tanker manifold which will permit the moored tanker to rotate about the mooring and to freely surge fore and aft and will further permit the rapid and safe transfer of cargo to or from the moored tanker.

Having in mind the above and other objects that will be evident from an understanding of this disclosure, the invention comprises the combinations and arrangements as illustrated in the presently preferred embodiment of the invention which is hereinafter set forth in such detail as to enable those skilled in the art readily to understand the function, operation, construction, and advantages of it when read in conjunction with the accompanying drawings.

DESCRIPTION OF THE PREFERRED EMBODIMENT

Figure 1:
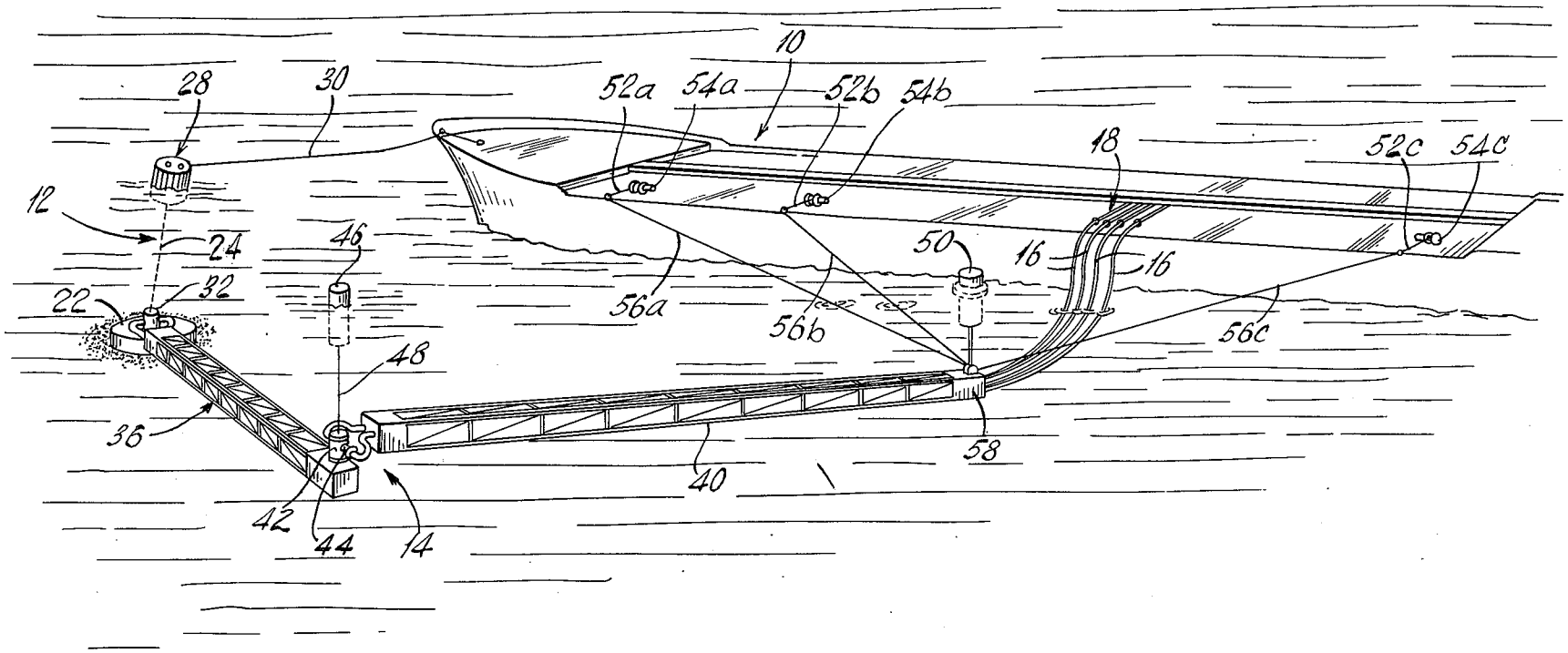
FIG. 1 illustrates a perspective view of an articulated loading arm attached to the base swivel of a single anchor leg mooring and terminating in hoses which are connected to the manifold of a moored tanker, according to the present invention.
Figure 2:
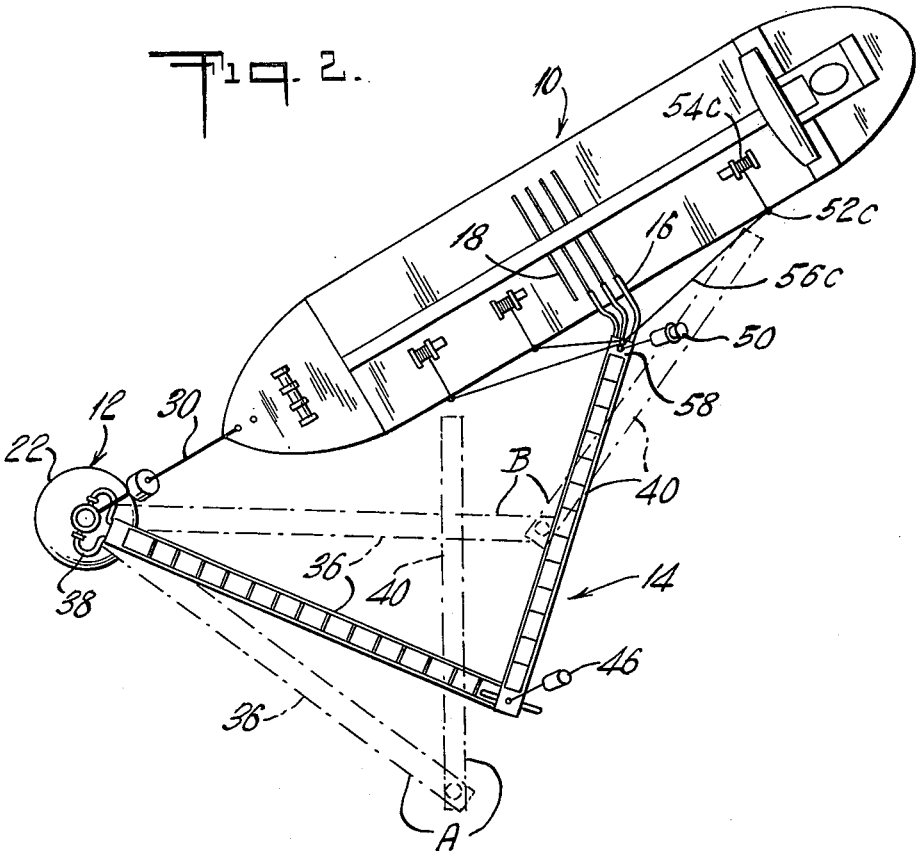
FIG. 2 illustrates a plan view of the articulated loading arm in its normal position and in phantom the position of the arm during maximum tanker forward surge (A) and during maximum tanker aft surge (B).

Having reference to like drawings wherein the reference numerals are used to designate similar parts throughout the several views, the present invention is illustrated in FIG. 1 in connection with a tanker 10 which is moored in place by means of a mooring such as the single anchor leg mooring system generally designated 12, as disclosed in U.S. Pat. Nos. 3,606,397 and 3,708,811, which are incorporated by reference to the extent required to describe such mooring. Obviously, other single point moorings can be employed with the articulated arm in this invention.

Figure 3:
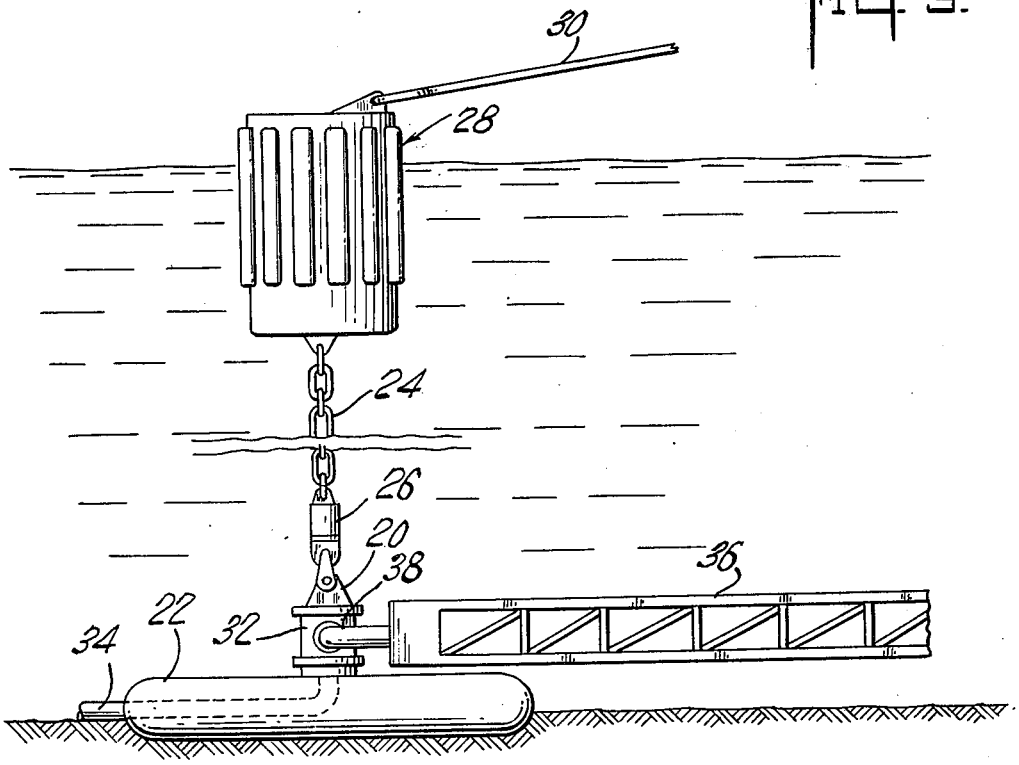
FIG. 3 illustrates the connection of the articulated loading arm to the base swivel of a single anchor leg mooring.

The transfer of cargo between the mooring and the tanker is accomplished by means of an articulated loading arm 14 which is connected at one end to the cargo swivel 32 of the single anchor leg mooring 12 and at its opposite end through end loading hoses 16 to the tanker manifold 18. As best illustrated in FIG. 3, the mooring typically comprises the shaft 20 rigidly fixed or pivoted on the base 22 and connected via a chain 24 and swivel 26 (which permits relative rotation between chain 24 and shaft 20) to the mooring buoy 28, which is connected to the tanker 10 through the mooring line 30.

The cargo swivel 32 which is rotatably mounted about the shaft 20, is disclosed in detail in U.S. Pat. No. 3,606,397, which is incorporated by reference. However, it should be understood that various other swivel means may be employed, such as the multi-product swivel disclosed in copending U.S. Pat. application Ser. No. 320,053 filed Jan. 2, 1973, now U.S. Pat. No. 3,838,718 and assigned to the assignee of the present invention, so long as the system provides concentric rotatable cargo conduit means and mooring load carrying means. A pipeline 34 extends between the anchored base 22 of the single anchor leg mooring and a suitable storage facility located either on land or at sea for transferring cargo either to or from the tanker.

Figure 4:
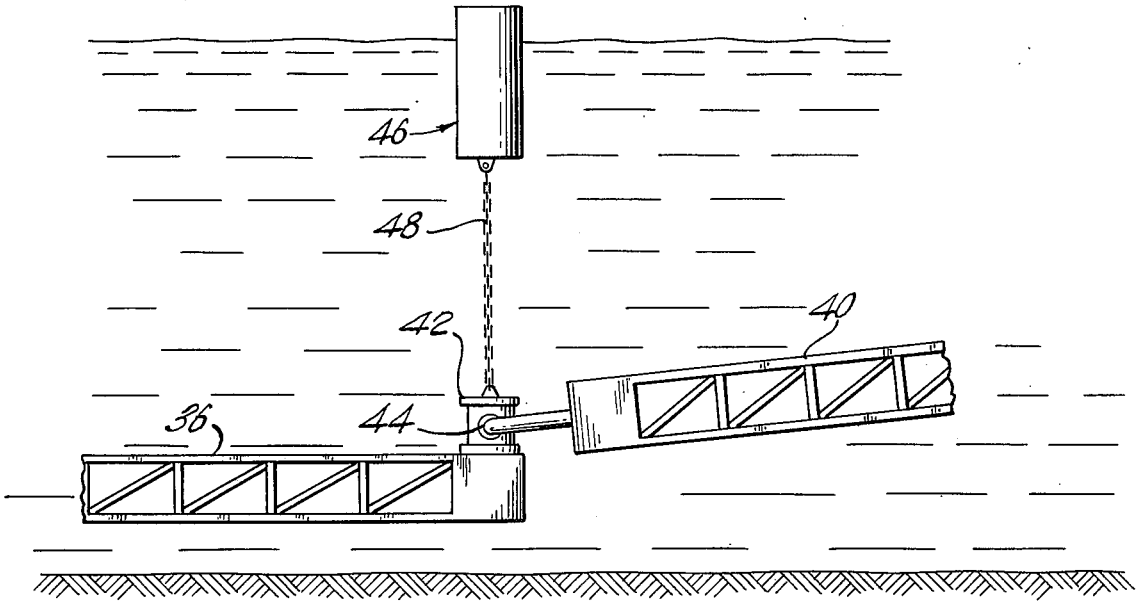
FIG. 4 illustrates the connection between the inboard and outboard loading arms and the intermediate support buoy.
Figure 5:
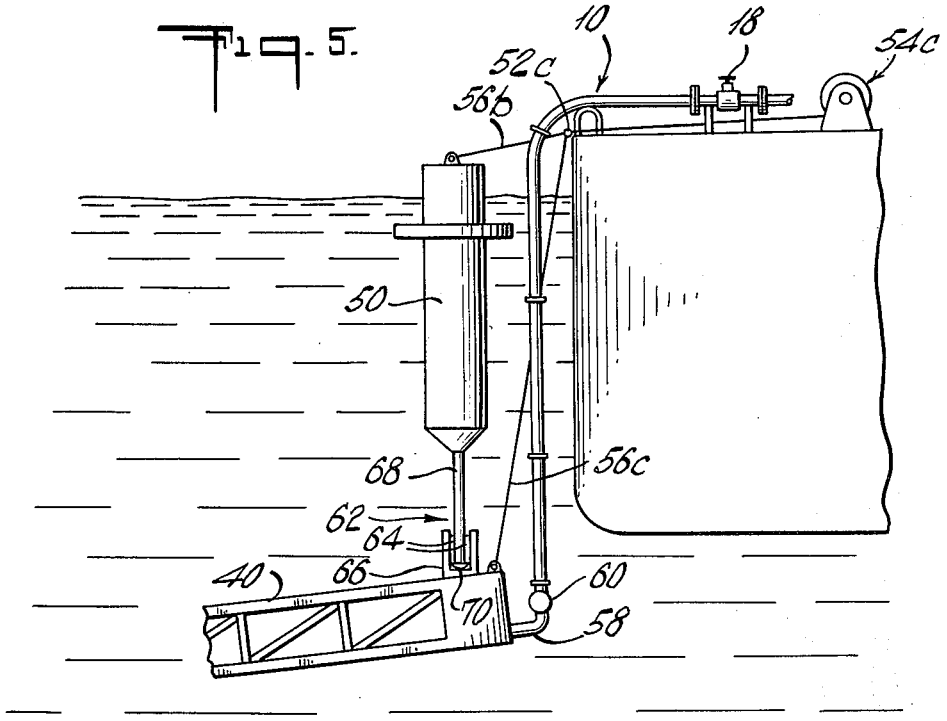
FIG. 5 illustrates the arrangement at the end of the outboard loading arm including the hoses and the end support buoy which is connected to the arm through an elastic joint.

The articulated loading arm 14 comprises a first or inboard arm 36 pivoted on horizontal swivels 38 (see FIG. 3) from the cargo swivel 32. This inboard arm is thus capable of 360° rotational movement in a horizontal plane and limited rotational or pivotal movement in a vertical plane. A second or outboard arm 40 is pivoted at the opposite end of the inboard arm 36 by means of a vertical intermediate swivel 42 having its axis substantially vertical and at right angles to the longitudinal centerline of the inboard arm and a pair of horizontal intermediate joints 44 (see FIG. 4) having their common axis substantially in a horizontal plane and at right angles to the longitudinal centerline of the outboard arm. This intermediate joint between the inboard and outboard loading arms is supported in spaced relation above the bottom of the sea floor by an intermediate support buoy 46 which is connected to the joint by a short length of chain or cable 48. The free end of the outboard arm 40 is supported by an end support buoy 50 which may be provided with conventional fendering means (not shown) to protect it in the event it should come in contact with or rest against the side of the tanker. The end support buoy 50 may be connected to the arm through a chain (similar to the connection of buoy 46 to intermediate joint swivel 42 via chain 48) or as shown schematically in FIG. 5, the connection may compromise an elastic or flexible pivot generally designated 62 which incorporates elastic or resilient bumpers or shear pads 64 to restrict the deflection of the buoy with respect to the arm. As shown, there is provided a female receptacle 66 secured to the end of the arm 40, having the bumpers 64 secured thereto and spaced apart to form a passageway as shown at 70 for receiving an elongated and suitable positioned thereto, tubular male member 68 extending down from the buoy 50. The member 68 preferably is rigid, with the desired flexibility of the pivot being provided by the bumpers 64. Alternatively, the member 68 may be flexible to some degree in order to provide the desired elasticity at the pivot.

A plurality of restraint lines **56*a*, 56*b* and 56*c* are connected between various spaced chock locations 52*a*, 52*b* and 52*c* along the length of the tanker and either the free end of the outboard arm 40 or the end support buoy 50. The tension in these lines is controlled by conventional winches 54*a*, 54*b* and 54*c*** on the tanker deck, and consequently, the end of the outboard arm can be positioned adjacent to the tanker manifold by adjusting the tension on the restraint lines.

At the end of the outboard loading arm 40 there is provided a manifold 58 to which one or a plurality of conventional loading hoses 16 are connected. Valves 60, operably associated within the manifold 58, are remotely operated from controls (not shown) preferably mounted on the support buoy 50 for the purpose of controlling cargo flow to or from the hoses. When it is desired to connect the system to a tanker for cargo transfer, the ends of the loading hoses 16, are lifted up to the tanker rail by means of the tanker derrick and then are connected to the tanker manifold 18 in a conventional manner as is now done at standard sea berths and conventional single point moorings. When not in use, the hoses can be lowered and stored underwater. Various hose tag identification lines may extend upwardly to the water surface from the hoses and be connected to the end support buoy when the hoses are thus stored.

In the operation of transferring cargo to the tanker from storage, the cargo flows through the pipeline 34 and through piping in the base 22 to the cargo swivel 32. From the cargo swivel, the cargo flows through the horizontal swivels 38 and piping in the inboard arm 36 to the intermediate swivels 42, 44, and then through piping in the outboard arm 40. At the end of the outboard arm cargo is selectively diverted through the manifold 58 to one or several of the loading hoses 16 and then passes to the tanker manifold 18. If offloading cargo from a tanker, cargo flows through the path described above in the opposite direction.

It will be appreciated from the foregoing description that while there has been disclosed a specific construction and arrangement, this is intended to be representative only of a preferred embodiment and that various changes may be made therein without departing from the clear teachings of the present disclosure. Accordingly, reference should be made to the following appended claims in determining the full scope of the invention.

What is claimed is:

1. A mooring and cargo transfer system for a tanker moored at an offshore site at sea comprising in combination:

a base anchored to the sea floor;

a mooring buoy located at the sea surface for mooring said tanker at said offshore site;

anchor leg means connecting said mooring buoy to said mooring base, including first cargo transfer swivel means operably connected for cargo transfer with underwater cargo piping;

underwater articulated loading arm means extending between said first cargo transfer swivel means and said tanker moored to said mooring buoy, said articulated loading arm means comprising an inboard arm constructed and arranged for cargo transfer therethrough and in cargo transfer relationship with said first cargo transfer swivel means and mounted at a first end for rotational movement in vertical and horizontal directions with respect to said mooring base and extending outwardly from said first cargo transfer swivel means an outboard arm constructed and arranged for cargo transfer therethrough and for movement in horizontal and vertical directions relative to said inboard arm, and intermediate joint means including second cargo transfer swivel means connecting the other end of said inboard arm and a first end of said outboard arm in cargo transfer relationship;

an intermediate joint support buoy located at the sea surface and connected to said intermediate joint means for supporting said joint means above said sea floor;

end support buoy means located at the sea surface and connected to the free end of said outboard arm for supporting said free end above the sea floor;

at least one flexible hose connected at said free end of said outboard arm for transferring cargo from said outboard arm to said moored tanker; and restraint means connected between said articulated loading arm means and said tanker for positioning said free end of said outboard arm adjacent a predetermined location on said tanker, to facilitate cargo transfer between said underwater piping and said tanker through said first cargo transfer swivel, said inboard arm, said second cargo transfer swivel means, said outboard arm and said flexible hose.

2. A mooring and cargo transfer system for a tanker when moored at an offshore site at sea comprising:

a mooring buoy located at the sea surface for mooring a tanker at said offshore site;

a mooring base secured to the sea floor;

anchor leg means connecting said mooring buoy to said mooring base, including base cargo transfer swivel means operably connected with underwater cargo transfer piping;

a submerged elongated inboard arm constructed for transferring cargo there through operably connected at one end with said base cargo transfer swivel means for rotational movement and extending outwardly from said base cargo transfer swivel means;

arm cargo transfer swivel means operably connected at the other end of said inboard arm in cargo transfer relation with said inboard arm;

a submerged elongated outboard arm constructed for transferring cargo there through operably connected at one end in cargo transfer relation with said arm cargo transfer swivel means and mounted for pivotal and rotational movement relative to said inboard arm and extending outwardly from said arm cargo transfer swivel means;

a swivel support buoy located at the sea surface for supporting said arm cargo transfer swivel means including the pivotal connection between said inboard and outboard arms;

an end support buoy for supporting the other end of said outboard arm above the sea floor;

at least one cargo transfer hose having one end operably connected in cargo transfer relation at an underwater position with said other end of said outboard arm and the opposite free end of said hose adapted for connection to a tanker moored to said mooring base.

3. The system of claim 2 further comprising arm restraint lines connected to said other end of said outboard arm for connection at spaced locations along the side of the moored tanker for properly positioning said other end of said outboard arm in relation to the tanker.

4. The system of claim 2 further comprising buoy restraint lines connected to said end support buoy for connection at spaced locations along the side of the moored tanker for properly positioning said end support buoy in relation to the tanker.

5. The system of claim 2 wherein said free end of said hose is located beneath the sea surface in the absence of a tanker moored to said system.

6. The system of claim 2, wherein said base cargo transfer swivel means is mounted for 360° rotation in a horizontal direction and said inboard arm is mounted with said base cargo transfer swivel means for vertical and horizontal rotational movement.

7. The system of claim 2, wherein said arm cargo transfer swivel means has a vertical axis located at substantially right angle relative to the longitudinal centerline of said inboard arm.

8. The system of claim 7, wherein said arm cargo transfer swivel means comprises a pair of opposed horizontal joints having a common axis of rotation located in a substantially horizontal plane and at substantially right angle relative to the longitudinal centerline of said outboard arm, for pivotally mounting said outboard arm relative to said inboard arm.

9. The system of claim 2, wherein said end support buoy is connected to said other end of said outboard arm by means of a chain.

10. The system of claim 2, wherein said end support buoy is connected to the other end of said outboard arm by means of an elastic pivot joint for restricting deflection of said end support buoy relative to said outboard arm.

11. The system of claim 10, wherein said elastic pivot joint includes bumper means.

* * * * *